US006843399B2

(12) United States Patent
Garcia

(10) Patent No.: US 6,843,399 B2
(45) Date of Patent: Jan. 18, 2005

(54) PAINTBALL STORAGE TUBE CARRIER

(75) Inventor: Alfonso Celaya Garcia, San Diego, CA (US)

(73) Assignee: JT USA, LLC, Chula Vista, CA (US)

( * ) Notice: Subject to any disclaimer, the term of this patent is extended or adjusted under 35 U.S.C. 154(b) by 66 days.

(21) Appl. No.: 10/224,617

(22) Filed: Aug. 19, 2002

(65) Prior Publication Data

US 2004/0031836 A1 Feb. 19, 2004

(51) Int. Cl.[7] ..... A45F 5/00

(52) U.S. Cl. ..... 224/665; 224/679; 224/680; 224/901.8

(58) Field of Search ..... 234/665, 679, 234/680–684, 901.8; 230/23.4, 835

(56) References Cited

U.S. PATENT DOCUMENTS

| | | | | | |
|---|---|---|---|---|---|
| 2,958,439 | A | * | 11/1960 | Yochem | 220/375 |
| 3,897,650 | A | * | 8/1975 | Pilston | 224/682 |
| 4,175,553 | A | * | 11/1979 | Rosenberg | 602/19 |
| 4,860,896 | A | * | 8/1989 | Snider | 220/23.4 |
| 5,060,835 | A | * | 10/1991 | Payne | 224/684 |
| 5,240,156 | A | * | 8/1993 | Sicotte et al. | 224/901.8 |
| 5,470,001 | A | * | 11/1995 | Konchan | 224/684 |
| 5,497,921 | A | * | 3/1996 | Dancyger et al. | 224/679 |
| 5,693,006 | A | * | 12/1997 | Slautterback | 602/19 |
| D417,951 | S | * | 12/1999 | deMontagnac | D3/215 |
| 6,158,642 | A | * | 12/2000 | Herbage | 224/901.8 |
| 2003/0121927 | A1 | * | 7/2003 | Rice et al. | 220/835 |

FOREIGN PATENT DOCUMENTS

| | | |
|---|---|---|
| FR | 2629796 | * 10/1989 |
| GB | 2252302 | * 5/1992 |

* cited by examiner

*Primary Examiner*—Nathan J. Newhouse
(74) *Attorney, Agent, or Firm*—Henri J. A. Charmasson; John D. Buchaca

(57) ABSTRACT

A belt caddy for carrying a number of cylindrical paintball containers during a war game. The outer face of the belt is lined with a first type of hook-and-loop fabric fastener. Each of the containers is surrounded by an elastic sleeve mounting over approximately half of its longitudinal outer surface, a first patch of a second type of hook-and-loop fastener and, over the remainder of the outer surface, the same type of hook-and-loop fabric fastener as the web. The containers can be bunched together in a pack and secured to the belt by interconnection of the hook-and-loop fastener materials. A pair of cooperating straps are used to further cinch the pack of containers to the belt.

14 Claims, 1 Drawing Sheet

PAINTBALL STORAGE TUBE CARRIER

FIELD OF THE INVENTION

This invention relates to tool belts, fabric caddies and more particularly to equipment used in the practice of paintball war games.

BACKGROUND OF THE INVENTION

During war games in which participants shoot frangible plastic balls full of a liquid dye at their opponents, hundreds of paintballs may be used by a single participant. Paintballs are ordinarily packaged into cylindrical containers which can be conveniently and quickly unloaded into the paintball magazine of a gun. The prior art has provided several types of paintball container carrying belts. The most common example of carrier has a series of pockets formed against the outside surface of the belt. Each pocket can securely nest one paintball container. A paintball warrior's belt may also be encumbered and burdened by other articles hanging from it or secured to it such as replacement goggle, flashlights, radio communication device, pouches of cleaning wipes and other miscellany to a point where only a very small number of paintball containers can be accommodated.

This invention results from an attempt to increase the paintball container carrying ability of a game participant.

SUMMARY OF THE INVENTION

The principal and secondary objects of this invention are to provide a paintball war game participant with a waist-mounted caddy that can accommodate a large number of spare paintball containers without encumbering the full length of a belt carrier, while allowing a quick detachment of the paintball container from the carrier without compromising the security of its attachment.

These and other valuable objects are achieved by a fabric belt in which a portion of the outer face is lined with a first type of hook-and-loop fabric fastener. A number of cylindrical paintball containers have their outside surface covered by a resilient sleeve formed over approximately one-half by a patch of a second type of hook-and-loop fabric fastener that can cooperatively grasp and cling to the strip lining the belt. A second half of the sleeve is formed by a patch of the first type of hook-and-loop fabric fastener as the belt strip. Accordingly, a number of sleeved containers can be bunched together to form an agglutination of up to twelve containers in several layers clinging to one another through the cooperative contact of their fabric fastener sections. The sleeve preferably includes a portion of elastomeric material so that it is securely but resiliently cinched around the container. The pack of containers can then be applied and secured against the strip on the outer face of the belt. A pair of cooperating straps having their roots attached at opposite sides of the strip of hook-and-loop fabric material can be wrapped around the pack of containers to secure their attachment to the belt.

DESCRIPTION OF THE PREFERRED EMBODIMENT OF THE INVENTION

Figure 1:
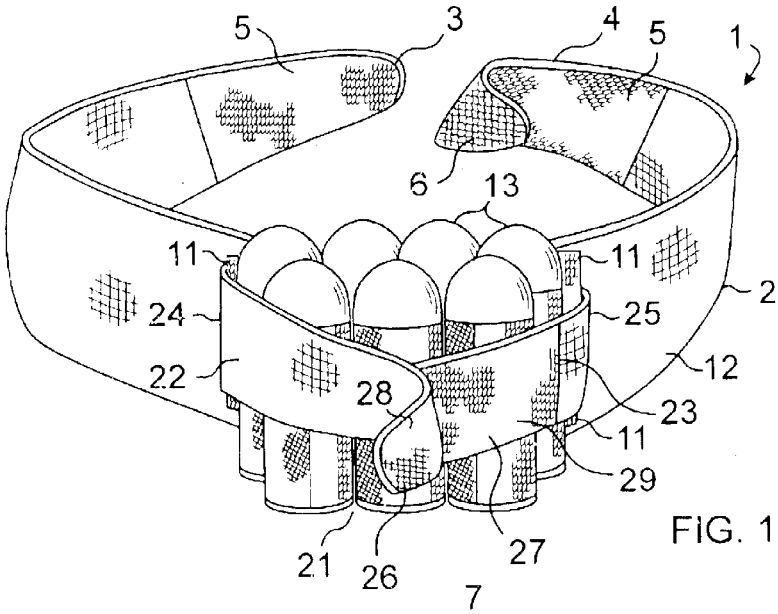
FIG. 1 is a front and top perspective view of a paintball carrier according to the invention.
Figure 2:
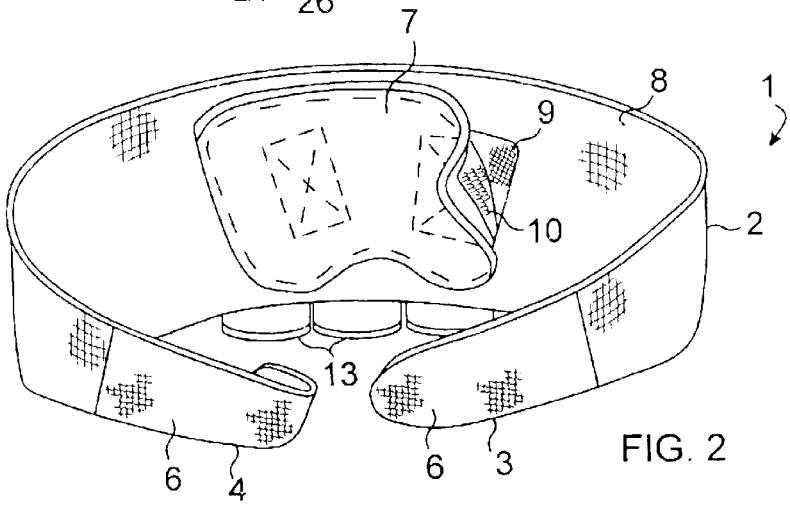
FIG. 2 is a back and top perspective view thereof.

Referring now to the drawing, there is shown a paintball storage tube carrier in the form of a belt caddy 1 which comprise a web 2 made of fabric, and is shaped and dimensioned to wrap around the waist of a user. The two free ends 3, 4 of the web are long enough to overlap each other. They are line on the inside with a first type of hook-and-loop fabric fastener 5 and similarly lined on the outside with a second type of hook-and-loop fabric fastener 6 that cooperates with the first type, so that the web can be conveniently cinched around the waist of the user and secured by the clinging contact between the two types of fastener.

It should be noted that in connection with this as well as other parts of the belt caddy, other types of contact-clinging materials besides the hook-and-loop fabric could be equivalently used such as sheets of patches of magnetic materials of opposite polarities, strips coated with releasable bonding substances such as a very tacky adhesive, dimple-and-nib textured sheets and other obvious flexible fastening substitutes.

A comfort lumbar pad 7 is removably applied to a median section of the inside face 8 of the web by means of cooperating patches 9, 10 of contact-clinging materials.

A large strip 11 of a first type of contact-clinging material is permanently secured to a median portion of the outer face 12 of the web and extends over approximately one-fourth of its length. A number of substantially symmetrical paintball containers 13 are shown clinging to the strip 11 and are secured in that position by further use of contact-clinging material as explained below.

Figure 3:
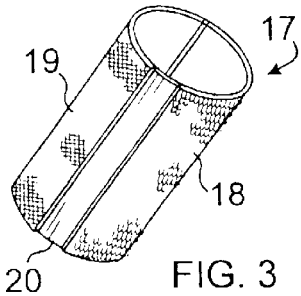
FIG. 3 is a perspective view of a paintball container sleeve.
Figure 4:
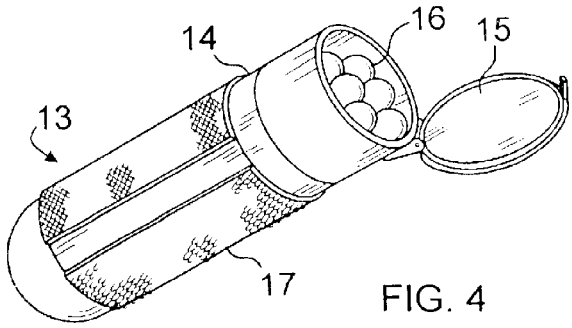
FIG. 4 is a perspective view of a paintball container equipped with the sleeve.

As more specifically illustrated in FIG. 4, each paintball carrier 13 has a cylindrical outer surface and a lockable cover 15. The carrier can accommodate 120 to 125 paintballs 16. A resilient sleeve 17 more specifically illustrated in FIG. 3, is cinchedly applied, and almost completely covers the cylindrical outer surface. The sleeve is made of two patches 18, 19 of contact-clinging material of different but cooperating types and a short length of elastomeric material 20 sewn side-by-side so that each patch covers approximately one longitudinal half of the outer surface of the container. A plurality of containers can be bunched together to form a multi-layer pack where each container clings to one or more other containers through the interlocking cooperation of its contact-clinging material patches 18, 19. Moreover, the entire pack clings to the strip 11 on the outer face of the belt and is held in that position by the cooperative entanglement of the contact-clinging materials of the strip and some or all of the container sleeves. The entire pack is further secured to the web by a pair of cooperating straps 22, 23. The roots 24, 25 of the straps are permanently attached to the web astride the lateral edges of the contact-clinging material strip 11. Their free ends 26, 27 are long enough to overlap when wrapped around the agglutination of the containers. Those ends are also provided with cooperating patches of hook-and-loop fabric fasteners 28, 29 or other contact-clinging materials.

While the preferred embodiments of the invention have been described, modifications can be made and other embodiments may be devised without departing from the spirit of the invention and the scope of the appended claims.

What is claimed is:

1. The combination of a belt caddy and a plurality of containers, said combination comprising:

a web shaped and dimensioned to wrap around the waist of a user;

said web having an inner face, outer face and means for cinching said web around said user's waist;

a strip of a first type of contact-clinging material applied to said outer face;

a plurality of substantially symmetrical containers each having an outer wall surface;

a sleeve applied to said surface, said sleeve comprising a first patch of a second type of contact-clinging material different, but cooperatively interlockable with said strip covering a first portion of said outer wall surface, and a second patch of said first type of contact-clinging material covering a second portion of said outer wall surface ooperatively interlockable with said first patch of another container;

whereby each of said containers is releasably secured to said strip or to at least another one of said containers by means of said patches.

2. The combination of claim 1, wherein said strip and patches of contact-clinging material comprises hook-and-loop fabric fastener.

3. The combination of claim 1, wherein said outer wall surface is cylindrical and each of said first and second portions extends longitudinally over approximately one-half of said outer wall surface.

4. The combination of claim 1, which further includes a pair of straps having roots secured astride said strip and overlapping free ends wrapped around an agglutination of said containers.

5. The combination of claim 4, wherein each of said straps comprise an inner surface lined with a first type of contact-clinging material, and an outer surface lined with a second type of contact-clinging material cooperatively interlockable with said first type.

6. The combination of claim 1, wherein said means for cinching comprise cooperating patches of contact-clinging materials.

7. The combination of claim 6, wherein said Cooperating patches include hook-and-loop fasteners.

8. The combination of claim 1, which further comprises a lumbar pad, and means for securing said pad to said inner face of the web.

9. The combination of claim 8, wherein said means for securing comprises cooperative patches of contact-clinging material.

10. The combination of claim 9, wherein said patches of contact-clinging material comprises hook-and-loop fabric fasteners.

11. The combination of claim 1, wherein each of said containers further comprises a sleeve lining said outer surface and mounting said patches.

12. The combination of claim 11, wherein said sleeve comprises an elastic portion resiliently cinching said sleeve against said outer surface.

13. The combination of claim 1, wherein said sleeve comprises a length of elastic material resiliently cinching said sleeve against said outer surface.

14. The combination of claim 13, wherein said patches comprises hook-and-loop fabric fasteners.

* * * * *

UNITED STATES PATENT AND TRADEMARK OFFICE

CERTIFICATE OF CORRECTION

PATENT NO. : 6,843,399 B2
APPLICATION NO. : 10/224617
DATED : January 18, 2005
INVENTOR(S) : Alfonso Celaya Garcia It is certified that error appears in the above-identified patent and that said Letters Patent is hereby corrected as shown below:

Column 3, line 13, the word "ooperatively" should read --cooperatively--.

Signed and Sealed this

Sixth Day of March, 2007

JON W. DUDAS
*Director of the United States Patent and Trademark Office*